US006598990B2

(12) United States Patent
Li

(10) Patent No.: US 6,598,990 B2
(45) Date of Patent: Jul. 29, 2003

(54) OUTDOOR UMBRELLA WITH POWER SUPPLY ARRANGEMENT FOR ELECTRICAL APPLIANCE

(76) Inventor: Wanda Yiing Li, 3000 S. Ocean Dr., 15C, Hollywood, FL (US) 33019

( * ) Notice: Subject to any disclaimer, the term of this patent is extended or adjusted under 35 U.S.C. 154(b) by 0 days.

(21) Appl. No.: 09/972,121

(22) Filed: Oct. 5, 2001

(65) Prior Publication Data

US 2003/0067765 A1 Apr. 10, 2003

(51) Int. Cl.[7] ..... A45B 23/00
(52) U.S. Cl. ..... 362/102; 362/800
(58) Field of Search ..... 362/102, 800

(56) References Cited

U.S. PATENT DOCUMENTS 5,053,931 A * 10/1991 Rushing ..... 362/102
6,089,727 A * 7/2000 Wu ..... 362/102
6,196,242 B1 * 3/2001 Xu ..... 135/20.1
6,270,230 B1 * 8/2001 Mai ..... 362/102
6,439,249 B1 * 8/2002 Pan et al. ..... 135/16

* cited by examiner

*Primary Examiner*—Sandra O'Shea
*Assistant Examiner*—Hargobind S. Sawhney
(74) *Attorney, Agent, or Firm*—Raymond Y. Chan; David and Raymond Patent Group

(57) ABSTRACT

An outdoor umbrella with power supply arrangement for electrical appliance includes an awning frame and a lighting arrangement. The awning frame includes an upper housing and a plurality of tubular awning arms radially extended from the upper housing in a pivotally movable manner. The lighting arrangement includes an electric hub disposed in the upper housing, a plurality of illuminating units each including a plurality of illuminators spacedly mounted on the awning arms, a connecting device having at least a first connector radially extended from the electric hub, and a second connector provided on each illuminating unit for electrically connecting to the first connector, so as to electrically connect the illuminating units with the electric hub, and a control device electrically connecting with the electric hub. Therefore, the illuminating units are electrically connected to the electric hub by connecting the second connectors to the first connectors when assembling the awning frame.

48 Claims, 7 Drawing Sheets

OUTDOOR UMBRELLA WITH POWER SUPPLY ARRANGEMENT FOR ELECTRICAL APPLIANCE

BACKGROUND OF THE PRESENT INVENTION

1. Field of the Invention

The present invention relates to an outdoor umbrella, and more particularly to an outdoor umbrella with power supply arrangement for electrical appliance, wherein a lighting arrangement comprises sections of power connection units pre-installed into the connecting parts of the outdoor umbrella respectively so that it not only facilitates the user to electrically connect and disconnect the lighting arrangement, but also simplifies the assembling and disassembling of the outdoor umbrella.

2. Description of Related Arts

Outdoor umbrellas are usually set up at outdoor area, such as the patio area, garden area, campground or beach area, to give a pleasant shade for a user, wherein a conventional outdoor umbrella comprises a supporting frame comprising a stand having a predetermined weight and a support stem upwardly extended from the stand, and a foldable awning supported by the supporting frame for providing a shading area.

In the dark, a user may merely mount a light fixture on the outdoor umbrella for illumination. The user may merely hang the light fixture on the supporting support stem of the outdoor umbrella when the outdoor umbrella is unfolded. Otherwise, a light bulb is installed into the foldable awning the outdoor umbrella. However, due to the folding and unfolding operations of the outdoor umbrella, the light is hard to be installed thereinto for fitting the folding movement of the foldable awning. In other words, the connection of the light fixture and the electrical power are complicated that will largely increase the installation and assembly cost of the outdoor umbrella.

Moreover, when the light fixture is installed on the outdoor umbrella, it is difficult to fold up or unfold the outdoor umbrella since the light fixture may alter the origin structural design of the outdoor umbrella. Especially when the light fixture is installed on the outdoor umbrella, it is difficult for the user to maintain and repair the light fixture and the electrical connection. Moreover, the external light fixture will destroy the overall appearance of the outdoor umbrella as well.

In addition, it is inconvenient for the user to extend an electrical cord from the light fixture to a power source around the outdoor umbrella. The user may trip over the hanging down and entangling electrical cord that may cause accidents.

SUMMARY OF THE PRESENT INVENTION

A main object of the present invention is to provide an outdoor umbrella with power supply arrangement for electrical appliance, wherein a lighting arrangement is pre-installed into the outdoor umbrella for well illuminating an area under the outdoor umbrella.

Another object of the present invention is to provide an outdoor umbrella with power supply arrangement for electrical appliance, wherein the lighting arrangement comprises sections of power connection units pre-installed into the connecting parts of the outdoor umbrella respectively, so that it not only facilitates the user to electrically connect and disconnect the lighting arrangement, but also simplifies the assembling and disassembling of the outdoor umbrella.

Another object of the present invention is to provide an outdoor umbrella with power supply arrangement for electrical appliance, wherein the folding and unfolding operations of the outdoor umbrella will not be interfered after the lighting arrangement is installed into the outdoor umbrella.

Another object of the present invention is to provide an outdoor umbrella with power supply arrangement for electrical appliance, wherein the lighting arrangement does not require to alter the original structural design of the outdoor umbrella, so as to minimize the manufacturing cost of the outdoor umbrella incorporating with the lighting arrangement.

Another object of the present invention is to provide an outdoor umbrella with power supply arrangement for electrical appliance, wherein the electrical cords and switchable power supply are pre-installed to extend inside the framework of outdoor umbrella, such as the awing arms, connecting arms and supporting arms, so that a user is safe and hassle-free to operate the lighting arrangement.

Another object of the present invention is to provide an outdoor umbrella with power supply arrangement for electrical appliance, wherein no expensive or complicate mechanical structure is required to employ in the present invention in order to achieve the above mentioned objects. Therefore, the present invention successfully provides an economic and efficient solution for incorporating the lighting arrangement with the outdoor umbrella.

Accordingly, in order to accomplish the above objects, the present invention provides an outdoor umbrella, which comprises:

- a fabric made awning;
- a foldable awning frame which is constructed to support said fabric awning thereon and comprises an upper housing, a lower housing, a plurality of tubular awning arms radially extended from the upper housing in a pivotally movable manner, and at least a tubular connecting arm pivotally connected one of the awning arms with the lower housing;
- a supporting frame comprising a support stem having an interior cavity and a supporting arm pivotally connecting the awning frame with the support stem; and
- a lighting arrangement, comprising:
  - an electric hub having an electric inlet disposed in the upper housing;
  - a plurality of illuminating units mounted on the awning arms respectively, wherein each of the illuminating units comprises a plurality of illuminators spacedly extended along the respective awning arm;
  - a plurality of connecting devices, each of which comprises a first connector and a second connector, for electrically connecting the plurality of illuminating units with the electric hub respectively, wherein the first connectors are radially provided on the electric hub and the second connectors are electrically provided on the illuminating units respectively, wherein each of the illuminating units is capable of electrically connecting with the electric hub by connecting the second connector thereof with the respective first connector; and
  - a control device which is provided along the supporting frame and comprises a power supply, an electric outlet detachably connecting to the electric inlet of the electric hub, and an electric cord electrically connecting the power supply with the electric outlet;

whereby while assembling the awning frame, a user is able to electrically connect the illuminating units to the electric hub by connecting the second connectors to the first connectors at the same time.

DETAILED DESCRIPTION OF THE PREFERRED EMBODIMENTS

Figure 1:
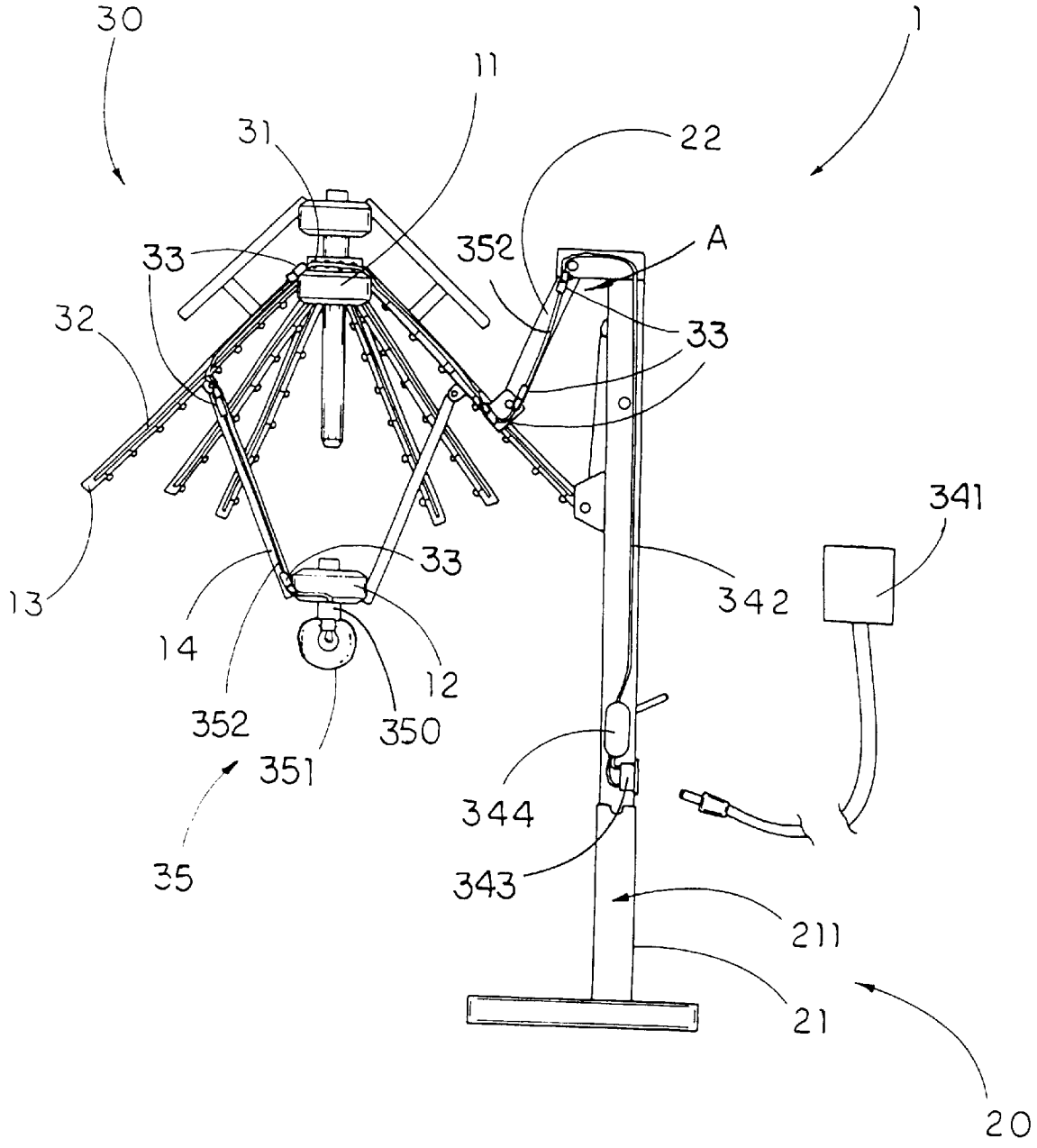
FIG. 1 is a sectional view of an outdoor umbrella with power supply arrangement for electrical appliance according to a preferred embodiment of the present invention.

Referring to FIG. 1 of the drawings, an outdoor umbrella 1 with power supply arrangement for electrical appliance according to a preferred embodiment of the present invention is illustrated, wherein the outdoor umbrella 1 comprises a fabric awning 1A, a foldable awning frame 10 which is constructed to support the fabric awning 1A thereon and a supporting frame 20 pivotally connected to the awning frame 10 so as to support the awning frame 10 in a suspended manner.

The awning frame 10 comprises an upper housing 11, a lower housing 12, a plurality of tubular awning arms 13 radially extended from the upper housing 11 in a pivotally movable manner, and at least a tubular connecting arm 14 pivotally connected one of the awning arms 13 with the lower housing 12.

The supporting frame 20 comprises a support stem 21 having an interior cavity 211 and a supporting arm 22 pivotally connected the awning frame 10 with the support stem 21. Therefore, the awning frame 10 is adapted to be folded up when the lower housing 12 is moved away from the upper housing 11 and to be unfolded when the lower housing 12 is moved towards the upper housing 11.

Figure 2:
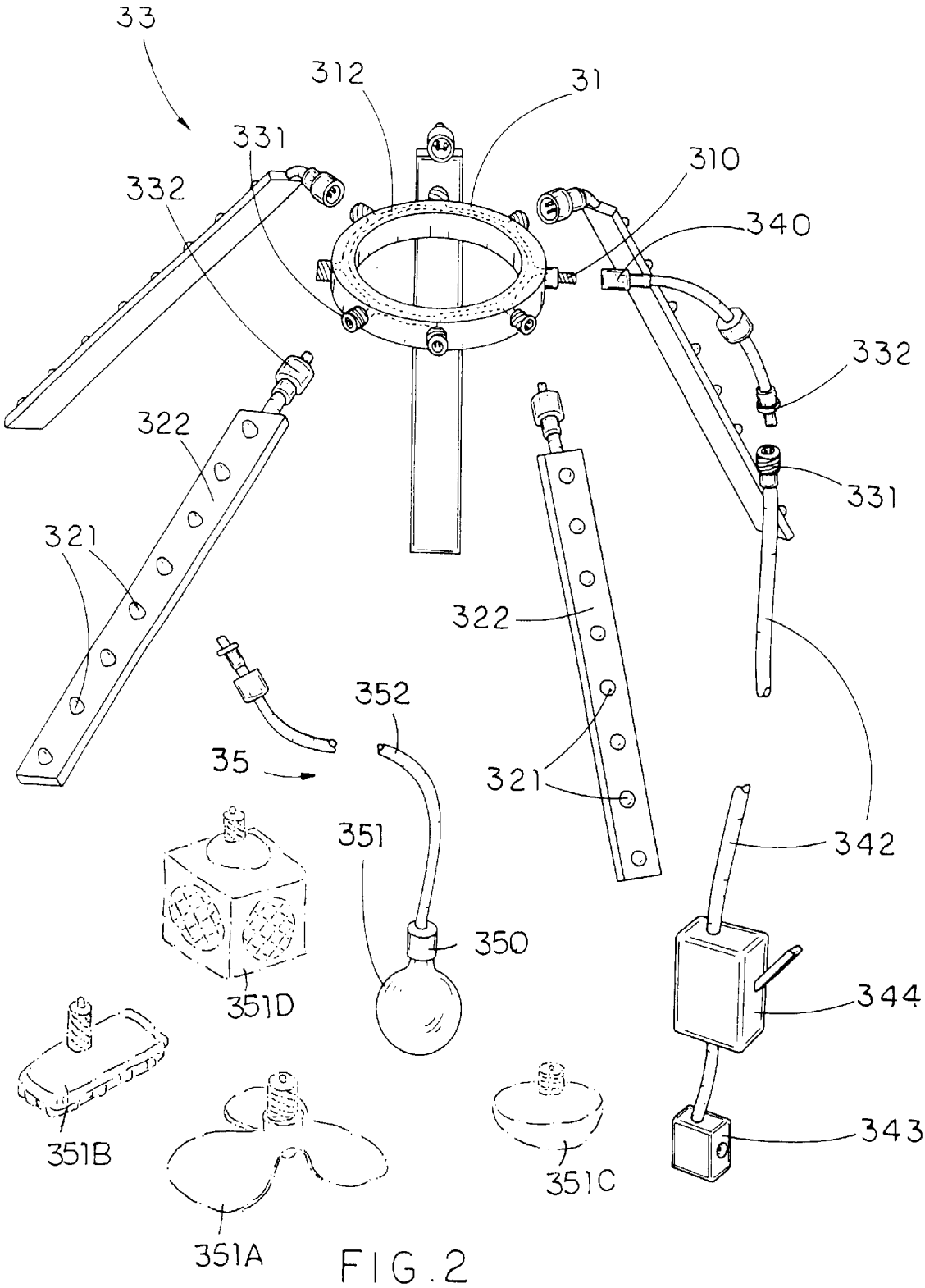
FIG. 2 is an exploded perspective view of a lighting arrangement of the outdoor umbrella with power supply arrangement for electrical appliance according to the above preferred embodiment of the present invention.

As shown in FIG. 2, the outdoor umbrella 1 further comprises a lighting arrangement 30 which comprises an electric hub 31, a plurality of illuminating units 321, a plurality of connecting devices 33, and a control device 34.

The electric hub 31 has an electric inlet 310 disposed in the upper housing 11. The plurality of illuminating units 32 are mounted on the awning arms 13 respectively, wherein each of the illuminators 321 comprises a plurality of illuminators 321 spacedly extended along the respective awning arms 13.

The plurality of connecting devices 33 are provided for electrically connecting the plurality of illuminating units 32 with the electric hub 31 respectively, wherein each of the plurality of connecting devices 33 comprises a first connector 331 and a second connector 332. The first connectors 331 are radially provided on the electric hub 31 and the second connectors 322 are electrically provided on of the illuminating units 32 respectively, wherein each of the illuminating units 32 is capable of electrically connecting with the electric hub 31 by connecting the second connector 322 with the respective first connector 321.

The control device 34 which is provided along the supporting frame 20 and comprises a power supply 341, an electric outlet 340 detachably connecting to the electric inlet 310 of the electric hub 31, and an electric cord 342 electrically connecting the electric outlet 340 with the power supply 341 with the electric outlet 340.

According to the preferred embodiment, each of the illuminating units 32 comprises an elongated element 322 for spacedly and electrically mounting the illuminators 321 thereon, wherein a length of the elongated element 322 should be shorter than that of the respective awning arm 13 such that the elongated element 322 will not be extended out of the ends of the awning arm 13 when the elongated element 322 is mounted on the awning arm 13.

As shown in FIG. 2, the illuminators 321 can be LEDs electrically installed on the elongated element 322 in such a manner that the illuminators 321 are spacedly aligned and affixed on the elongated element 322. In other words, the illuminators 321 are evenly distributed on the awning frame 10 along the awning arms 13, so as to enlarge the illuminating area of the outdoor umbrella 1.

Alternatively, the illuminators 321 are a plurality of replaceable light bulbs electrically connected on the elongated element 322 in series via a bulb housing, wherein the illuminators 321 are also spacedly aligned and affixed on the elongated element 322. Therefore, the light intensity of the illuminator 321 can be adjusted to fit the need of the user and the illuminators 321 can be replaced easily and individually without the need of replacing the whole illuminating unit 32.

As shown in FIG. 2, the plurality of first connectors 331 of the connecting device 33 are radially and electrically extended from the electric hub 31 and the plurality of corresponding second connectors 332 are electrically connected to inner ends of the elongated elements 322 respectively in such a manner that the illuminating units 32 are adapted to electrically connect to the electric hub 31 by electrically connecting the second connectors 332 with the first connectors 331 in a sealed and water tight manner respectively.

Figure 6:
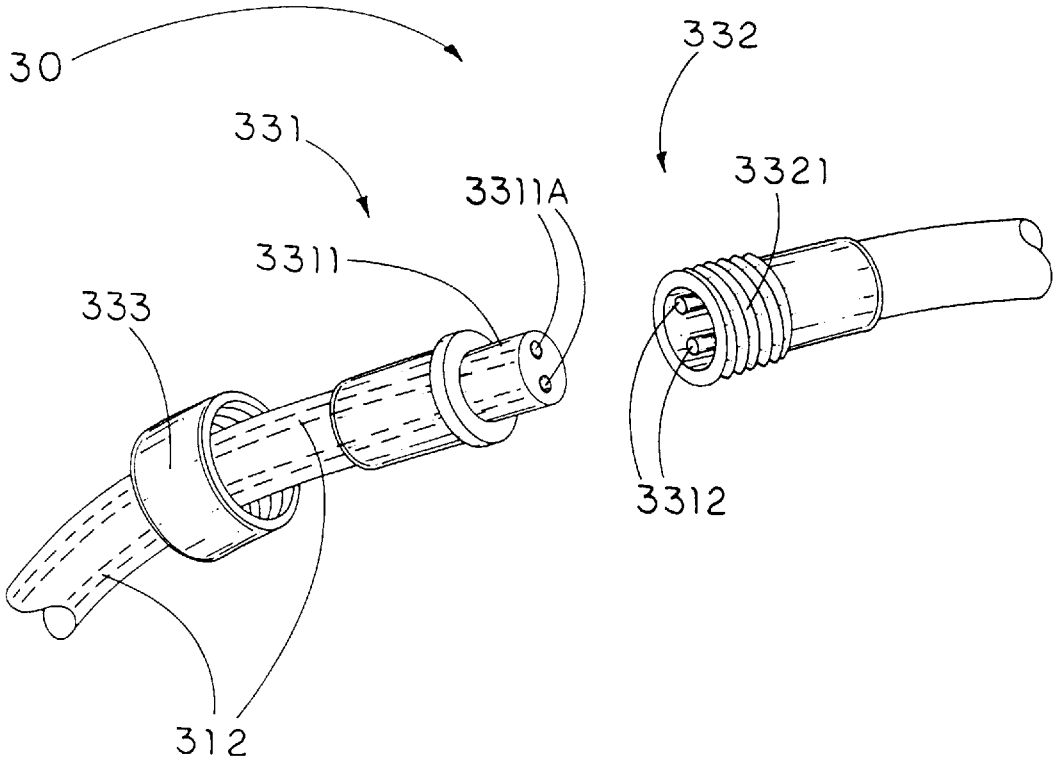
FIG. 6 is an exploded perspective view of the first and second connectors of the outdoor umbrella with power supply arrangement for electrical appliance according to the above preferred embodiment of the present invention.
Figure 7:
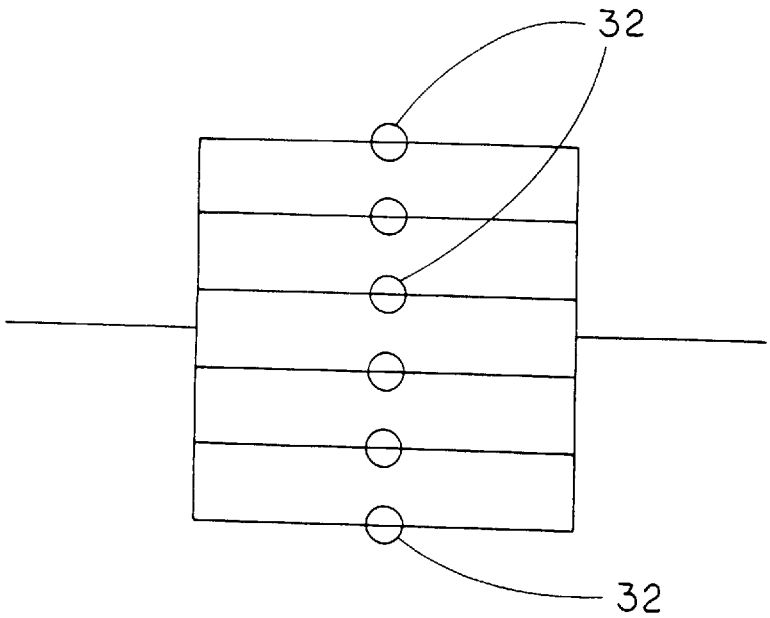
FIG. 7 is a circuit diagram of the outdoor umbrella with power supply arrangement for electrical appliance according to the above preferred embodiment of the present invention.

The electric hub 31 comprises a hub casing 311 having a circular shaped received in the upper housing 11 of the awning frame 10 and at least a pair of electric wires 312, protected by the hub casing 311, electrically connecting the first connectors 331 in a parallel connection. In other words, the illuminating units 32 are electrically connected together in a parallel connection via the electric hub 32, as shown in FIG. 6, such that the operation of the lighting arrangement 30 will not be interfered when one of the illuminating units 321 is out of function. Of course, the first connectors 331 can also simply be electrically connected with each other in a series connection manner.

As shown in FIG. 6, the first connector 331 comprises a tubular holder 3311 which has a pair of engaging slots 3311*a* provided at the tubular holder 3311 wherein ends of the electric wires 312 are extended to the tubular holder 3111 through the engaging slots 3311*a* respectively.

The second connector 332 comprises a connecting head 3321 which has a rod-like shaped adapted to fittingly receive in the tubular holder 3311 of the first connector 331 and a pair of parallel terminals 3312 outwardly protruded from the connecting head 3321 and electrically connected to the illuminators 321 for fittingly inserting into the engaging slots 3311*a* respectively, so as to electrically connect the illuminating units 32 to the electric hub 31.

The connecting device 33 further comprises a ring-shaped locker 333 slidably connected to the connecting head 3321 of the second connector 332 wherein the locker 333 has an inner threaded portion adapted to fittedly screw with an outer threaded portion of the tubular holder 3311 of the first connector 331, so as to securely lock up the second connector 332 with the first connector 331 and prevent rain and moisture from entering to the first and second connectors 331, 332.

Figure 3:
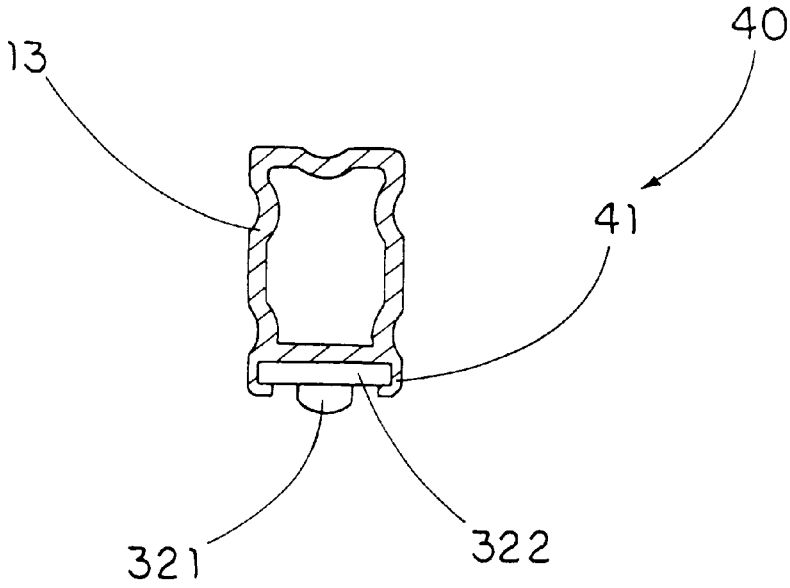
FIG. 3 is a sectional view of an illuminating unit of the outdoor umbrella with power supply arrangement for electrical appliance according to the above preferred embodiment of the present invention.

As shown in FIG. 3, in order to mount the illuminating units 32 on the awning arms 13 respectively, the outdoor umbrella 1 further comprises a plurality of mounting arrangements 40 each of which contains an elongated mounting slot 41, having a U-shaped cross section, extended along a bottom side of the respective awning arm 13, wherein the elongated element 322 of the illuminating unit 32 is fittedly received in the mounting slot 41, with the illuminators 321 facing downwards, so as to securely mount the illuminating unit 32 on the respective awning arm 13.

Figure 4:
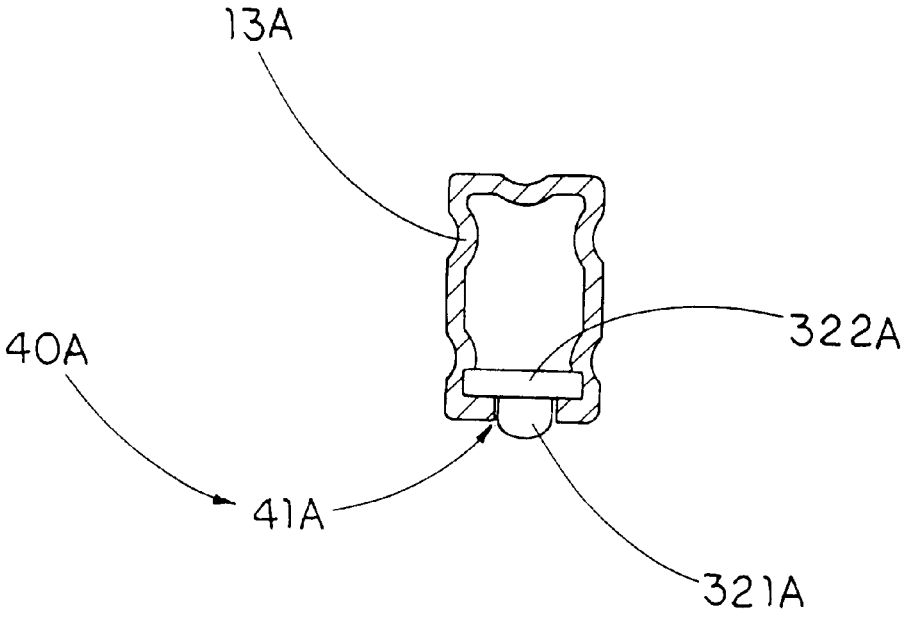
FIG. 4 is a first alternative mode of a mounting arrangement of the outdoor umbrella with power supply arrangement for electrical appliance according to the above preferred embodiment of the present invention.

FIG. 4 illustrates a first alternative mode of the mounting arrangements 40A each of which contains a plurality of through holes 41A spacedly provided on the respective awning arm 13A wherein the elongated element 322A is extended inside the respective tubular awning arm 13A and at least the head portions of the illuminators 321A are arranged to protrude outside the respective awning arms 13A through the through holes 41A respectively.

Figure 5:
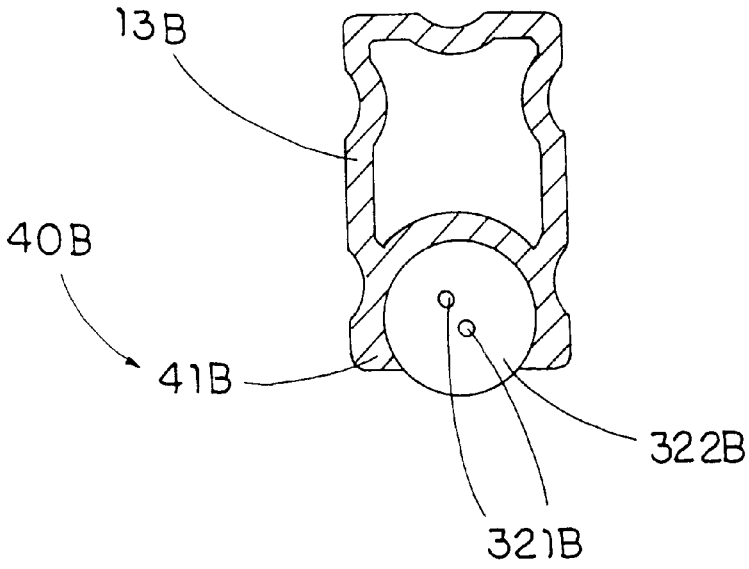
FIG. 5 is a second alternative mode of the mounting arrangement of the outdoor umbrella with power supply arrangement for electrical appliance according to the above preferred embodiment of the present invention.

FIG. 5 illustrates a second alternative mode of the mounting arrangements 40B adapted for using a rope light, as shown in FIG. 6, as the illuminating unit 32B, each of which contains an elongated mounting slot 41B, provided on each of the awning arms 13B, having an arc-shaped cross section and opening downward, wherein the elongated element 322B, which has a tubular shape for receiving the illuminators 321B therein, is fittedly received in the mounting slot 41B so as to securely mount the rope light type illuminating unit 32B on the respective awning arm 13B.

The power supply 341 of the lighting arrangement 30 is capable of using both AC current supplied by normal AC power outlet and DC current supplied by a battery. In order to use both AC current and DC current, as shown in FIG. 1, the control device 34 further comprises a power adapter 343 supported by the support stem 21 for electrically converting both AC ad DC currents to an optimum electric power to the illuminating units 32. In other words, lighting arrangement 30 can be set up outdoors while using DC current (batteries) or using AC current (power outlet). It is worth to mention that the power supply 341 can also be a solar energy power supply that directly converts and store the energy of sunlight into electric energy for supplying the lighting arrangement 30.

The control device 34 further comprises a power switch 344 supported by the support stem 21 and electrically connected to the electric cord 342 inside the interior cavity 211 of the support stem 21 for selectively switching the illuminating units 32 on and off.

As shown in FIGS. 1 and 2, the lighting arrangement 30 further comprises an auxiliary electrical apparatus 35, which comprises an electric socket holder 350 mounted underneath the lower housing 12 of the awning frame 10, an electrical appliance 351 electrically connected to the electric socket holder 350, and a connecting wire 352 electrically extended from the electric socket holder 350 to the electric hub 31 through the supporting arm 22 14, as shown in FIG. 1.

It is worth to, as shown in FIG. 2, the electrical appliance 351 can be a light bulb, which can also be replaced by an electric fan 351A, an electric heater 351B, an insert repellent device 351C, or even an audio system 351D, such that the electrical appliance 351 is capable of being interchanged to fit the need of the user, as shown in FIG. 2. Another essential feature of the present invention is that the lighting arrangement 30 comprises sections of power connection units pre-installed into the connecting parts of the outdoor umbrella respectively. Each of the power connection units comprises one of the connecting device 33 and a section of the connecting wire 352 or the electric wire 342 extended along the respective connecting part, i.e. the connecting arm 14, the supporting arm 22, or the awning arms 13, wherein the first and second connectors 331, 332 are electrically connected to two ends of the connecting wire 352 and extended to the two ends of the connecting part. When connecting two connecting parts mechanically, the first connector 331 of one connecting part, e.g. the supporting arm 22, can be detachably connected with the second connector 332 of adjacent connecting part, e.g. the awning arm 13.

In other words, as shown in FIG. 1, the electrical connection of the lighting arrangement 30 according to the preferred embodiment of the present invention provides that the illuminating unit 32 and/or the auxiliary electrical apparatus 35 can be detachably connected with each other. For example, the electric cord 342 is cut into predetermined sections wherein the first connector 331 is provided at one end of the section of the electric cord 342 and the second connector 332 is provided at another end thereof in such a manner that the sections of the electric cord 342 is detachably connected together by connecting the second connector 332 with the first connector 331. Therefore, sections of the electric cord 342 can be firstly connected together before or after assembling the awning frame 10 of the outdoor umbrella 1. In other words, the lighting arrangement 30 is pre-installed into the outdoor umbrella 1, so as to easily connect the lighting arrangement 30 at the time while assembling the outdoor umbrella.

The above construction feature substantially solves a big headache of connecting the electrical cords. Generally, if the outdoor umbrella 1 is assembled first, it is very difficult to penetrate the electrical cords through the connected arms. If we want to install the electrical cord first, the manufacturer must get all connecting parts ready and then penetrate the electrical cord through all the separating parts in specific order before connecting the parts together. It is also very troublesome. However, according to the present invention, different production lines can manufacture different connecting parts, such as the support stem 21, the supporting arm 22, the upper housing 11, the awning arms 13, the connecting arms 14, and the lower housing 12, independently and pre-install a power connection unit A inside each connecting part with the first and second connectors 331, 332 being extended and mounted to two ends of the connecting part respectively. Therefore, the manufacturer does not need to worry about the electrical power supply and simply connects all parts together to form the outdoor umbrella 1. Then, the power supply will be arranged simply by connecting all adjacent first and second connectors 331, 332 which are mounted at two neighboring ends of connecting parts, as shown in FIG. 1. Of course, when the user needs to replace any connecting part, he has no need to replace the entire power supply arrangement. Rather, he may simply reconnect the power connection unit A by connecting the first and second connectors 331, 332 thereof with the neighboring power connection units A.

In other words, the present invention not only facilitates the user to electrically connect and disconnect the lighting arrangement, but also simplifies the assembling and disassembling of the outdoor umbrella. Moreover, all the wires including the electric cords 342 and the connecting wires 352 are received inside the outdoor umbrella 1 so as to prevent the wires being broken and thus keep the aesthetic appearance of the outdoor umbrella 1.

Figure 8:
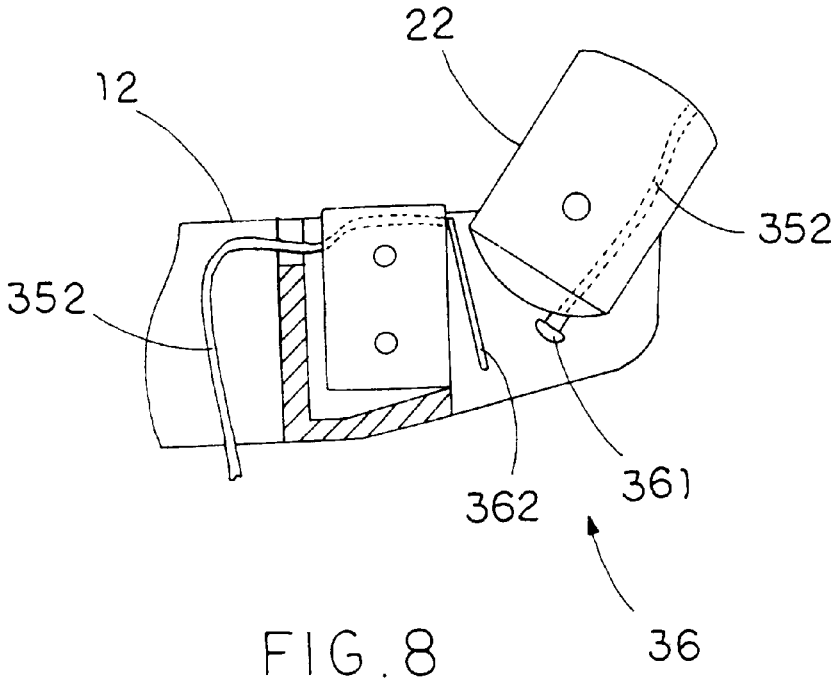
FIG. 8 is a sectional view of an auto-switch of the outdoor umbrella with power supply for electric appliance according to the above preferred embodiment of the present invention.

As shown in FIG. 8, the lighting arrangement 30 further comprises an auto-switch 36 to automatically switchoff the lighting arrangement 30 when the outdoor umbrella 1 is folded up so as to ensure the electrical circuit is cut when the umbrella is not in use. The auto-switch 36 comprises a resilient element 361 supported in the lower housing 12 and a contacting head 362 outwardly protruded from an inner end of the respective supporting arm 22 and arranged to maintain biasing against the resilient element 361 when the supporting arm 22 is pivotally moved with respect to the lower housing 12 while the awning frame 10 is unfolded, that is the connecting wires 352 inside the supporting arm 22 and the lower housing 12 are electrically connected to provide electricity.

In addition, the connecting wire 352 is cut into two sections for the resilient element 361 and the contacting head 362 affixed thereto in such a manner that the contacting head 362 biases against resilient element 361 to close the circuit of the lighting arrangement 30, so as to switch on the illuminating units 32 and the auxiliary electrical apparatus 35. In other words, the auto-switch 36 can ensure the lighting arrangement 30 is switched off when the user folds up the outdoor umbrella.

In order to save space for storage or transportation for the outdoor umbrella 1, the outdoor umbrella 1 can be detached into several parts. For example, the supporting arm 22 can be detached from the support stem 21 and the awning frame 10 can be detached from the supporting arm 22. In other words, most of the movable parts of the outdoor umbrella 1 can be detached from each other such that the outdoor umbrella 1 can be disassembled into a compact unit.

Figure 9:
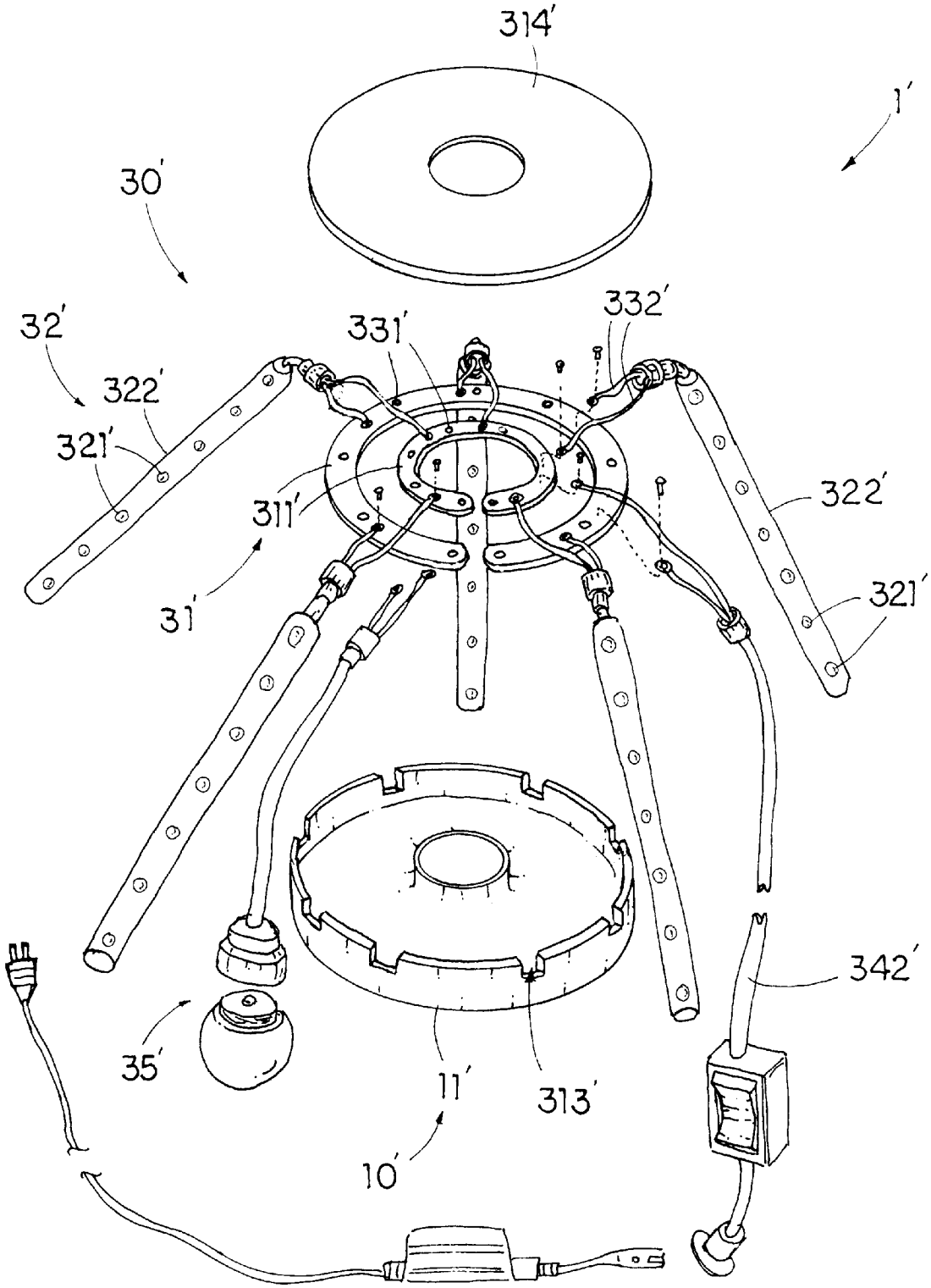
FIG. 9 is an alternative mode of an electric hub of the outdoor umbrella with power supply arrangement for electrical appliance according to the above preferred embodiment of the present invention.

FIG. 9 illustrates an alternative mode of the electric hub 31' which comprises two C-shaped hub members 311', having a positive charge and a negative charge respectively, coaxially disposed in the upper housing 11' of the awning frame 10' wherein the first connectors 331' are spacedly provided on the two hub members 311' for electrically connecting the second connectors 332' of the illuminating units 32'.

Each of the second connectors 332' has two connecting wires extended from the elongated element 322' and arranged to securely mounted on the two first connectors 331' respectively, so as to electrically connect the illuminating units 32' to the electric hub 31'.

Accordingly, the electric hub 31' further contains a plurality of U-shaped positioning grooves 313' radially provided on the upper housing 11' for inner ends of the illuminating units 32' fittedly receiving thereon and a housing cover 314' for enclosing the upper housing 11', so as to protect the electric hub 31' inside the upper housing 11'. It is worth to mention that such arrangement is specifically designed for the outdoor umbrella 1' that the lighting arrangement 30' is set up permanently while assembling the awning frame 10' since the user may not always need to disassemble the outdoor umbrella 1', so as to ensure the electrical connection of the lighting arrangement 30'.

Accordingly, if any of the illuminating units 32 is out of order, the user may simply detach the old one by disconnecting the connecting device 33 positioned between the awning arm 13 and the connecting arm 14. Then, the user may install a new illuminating unit 32 to the respectively arm 14 and reconnect the connecting device 33 again for power supply. It is so convenience that the user may change different types of illuminating units 32 to use from time to time.

Figure 10:
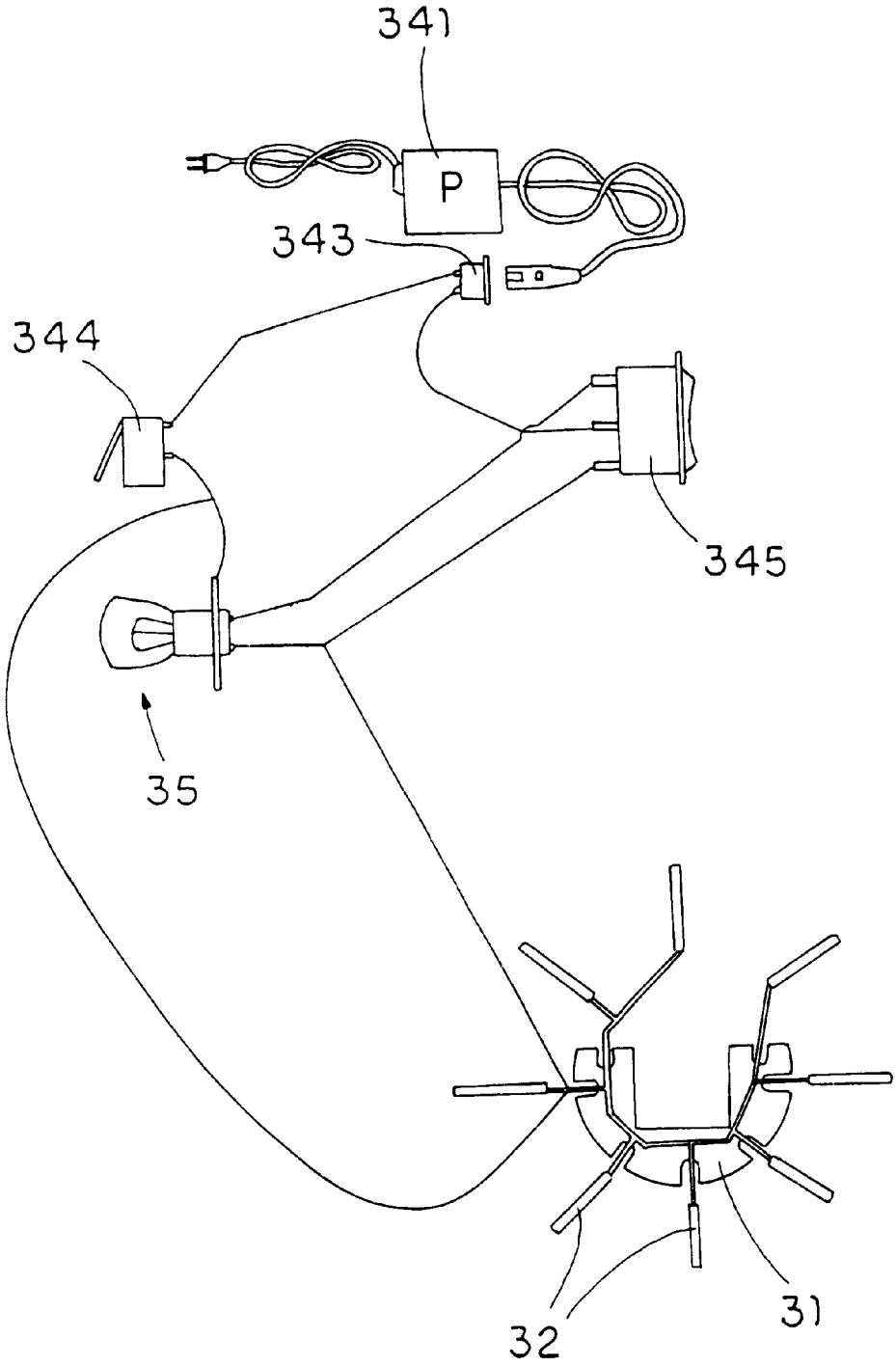
FIG. 10 illustrates an electrical connection of the outdoor umbrella with power supply for electric appliance according to the above preferred embodiment of the present invention.

As shown in FIG. 10, furthermore, the control device 34 may comprise a three-way switch 345 which has one input electrically connected with the power supply 341 and two outputs electrically connected with the electric hub 31 and the auxiliary electrical apparatus 35 respectively, wherein the three-way switch 345 is adapted for selectively switching on the illuminating units 32 and the auxiliary electrical apparatus 35.

In view of above, the outdoor umbrella of the present invention provides with power supply arrangement for electrical appliance that can substantially achieve the following features:

(1) The lighting arrangement comprises sections of power connection units pre-installed into the connecting parts of the outdoor umbrella respectively, so that it not only facilitates the user to electrically connect and disconnect the lighting arrangement, but also simplifies the assembling and disassembling of the outdoor umbrella.

(2) The folding and unfolding operations of the outdoor umbrella will not be interfered after the lighting arrangement is installed into the outdoor umbrella.

(3) The lighting arrangement does not require to alter the original structural design of the outdoor umbrella, so as to minimize the manufacturing cost of the outdoor umbrella incorporating with the lighting arrangement.

(4) The electrical cords and switchable power supply are pre-installed to extend inside the framework of outdoor umbrella, such as the awing arms, connecting arms and supporting arms, so that a user is safe and hassle-free to operate the lighting arrangement.

(5) No expensive or complicate mechanical structure is required to employ in the present invention in order to achieve the above mentioned advantages. Therefore, the present invention successfully provides an economic and efficient solution for incorporating the lighting arrangement with the outdoor umbrella.

What is claimed is:

1. An outdoor umbrella, comprising:

an awning;

a foldable awning frame which is constructed to support said awning thereon and comprises an upper housing, a lower housing, a plurality of awning arms radially extended from said upper housing in a pivotally movable manner, and at least a connecting arm pivotally connected one of said awning arms with said lower housing;

a supporting frame comprising a support stem and a supporting arm pivotally connecting said awning frame with said support stem; and a lighting arrangement, comprising:

an electric hub having an electric inlet disposed in said upper housing;

a plurality of illuminating units mounted on said awning arms respectively, wherein each of said illuminating units comprises a plurality of illuminators spacedly extended along said respective awning arm;

a plurality of connecting devices, each of which comprises a first connector and a second connector, for electrically connecting said plurality of illuminating units with said electric hub respectively, wherein said first connectors are radially provided on said electric hub and said second connectors are electrically provided on said illuminating units respectively, wherein each of said illuminating units is capable of electrically connecting with said electric hub by connecting said second connector thereof with said respective first connector; and a control device which is provided along said supporting frame and comprises a power supply, an electric outlet detachably connecting to said electric inlet of said electric hub, and an electric cord electrically connecting said power supply with said electric outlet.

2. The outdoor umbrella, as recited in claim 1, wherein each of said illuminating units further comprises an elongated element mounted on said respective awning arm of said awning frame with said illuminators electrically and spacedly provided along said elongated element and said second connector is electrically connected to an inner end of said elongated element.

3. The outdoor umbrella, as recited in claim 2, wherein said electric hub comprises a hub casing having a circular shaped received in said upper housing of said awning frame and at least a pair of electric wires protected by said hub casing for electrically connecting said first connectors.

4. The outdoor umbrella, as recited in claim 3, wherein said first connector comprises a tubular holder having a pair of engaging slots provided at a bottom surface of said tubular holder wherein ends of electric wires inside said electric hub are extended to said tubular holder through said engaging slots respectively, wherein said second connector comprises a connecting head having a rod-like shaped adapted to fittingly receive in said tubular holder of said first connector and a pair of parallel terminals outwardly protruded from said connecting head and electrically connected to said illuminators for fittingly inserting into said engaging slots respectively, so as to electrically connect said illuminating units to said electric hub.

5. The outdoor umbrella, as recited in claim 3, wherein said electric cord is cut into predetermined sections wherein said first connector is provided at one end of said respective section of said electric cord and said second connector is provided at another end thereof, wherein said sections of said electric cord is detachably connected together by connecting said second connector with said first connector when assembling said outdoor umbrella.

6. The outdoor umbrella, as recited in claim 2, wherein said electric hub comprises two C-shaped hub members, having a positive charge and a negative charge respectively, coaxially disposed in said upper housing of said awning frame wherein said first connectors are spacedly provided on said two hub members for electrically connecting said second connectors of said illuminating units respectively, wherein each of said second connectors has two connecting wires extended from said elongated element and arranged to mount on said two first connectors respectively, so as to electrically connect said illuminating units to said electric hub.

7. The outdoor umbrella, as recited in claim 6, wherein said electric cord is cut into predetermined sections wherein said first connector is provided at one end of said respective section of said electric cord and said second connector is provided at another end thereof, wherein said sections of said electric cord is detachably connected together by connecting said second connector with said first connector when assembling said outdoor umbrella.

8. The outdoor umbrella, as recited in claim 2, further comprising an auxiliary electrical apparatus which comprises an electrical appliance mounted underneath said lower housing of said awning frame and a connecting wire electrically extended from said electrical appliance to said electric hub through said connecting arm.

9. The outdoor umbrella, as recited in claim 2, wherein each of said awning arms has an elongated mounting slot provided thereon and said elongated element of said illuminating unit is fittedly received in said mounting slot so as to securely mount said illuminating unit on said awning arm.

10. The outdoor umbrella, as recited in claim 9, wherein said electric hub comprises two C-shaped hub members, having a positive charge and a negative charge respectively, coaxially disposed in said upper housing of said awning frame wherein said first connectors are spacedly provided on said two hub members for electrically connecting said second connectors of said illuminating units respectively, wherein each of said second connectors has two connecting wires extended from said elongated element and arranged to mount on said two first connectors respectively, so as to electrically connect said illuminating units to said electric hub.

11. The outdoor umbrella, as recited in claim 10, wherein said electric cord is cut into predetermined sections wherein said first connector is provided at one end of said respective section of said electric cord and said second connector is provided at another end thereof, wherein said sections of said electric cord is detachably connected together by connecting said second connector with said first connector when assembling said outdoor umbrella.

12. The outdoor umbrella, as recited in claim 11, wherein each of said mounting slots has an arc-shaped cross section and opening downward and each of said elongated elements has a tubular shape for receiving said illuminators therein and being fittedly received in said respective mounting slot so as to securely mount said illuminating unit on said awning arm.

13. The outdoor umbrella, as recited in claim 11, wherein each of said awning arms has an elongated mounting slot having a U-shaped cross section formed thereon and said elongated element of said illuminating unit is fittedly received in said mounting slot so as to securely mount said illuminating unit on said awning arm.

14. The outdoor umbrella, as recited in claim 11, further comprising an auxiliary electrical apparatus which comprises an electrical appliance mounted underneath said lower housing of said awning frame and a connecting wire electrically extended from said electrical appliance to said electric hub through said connecting arm.

15. The outdoor umbrella, as recited in claim 10, further comprising an auxiliary electrical apparatus which comprises an electrical appliance mounted underneath said lower housing of said awning frame and a connecting wire electrically extended from said electrical appliance to said electric hub through said connecting arm.

16. The outdoor umbrella, as recited in claim 9, wherein each of said awning arms has an elongated mounting slot having a U-shaped cross section formed thereon and said elongated element of said illuminating unit is fittedly received in said mounting slot so as to securely mount said illuminating unit on said awning arm.

17. The outdoor umbrella, as recited in claim 9, wherein each of said mounting slots has an arc-shaped cross section and opening downward and each of said elongated elements has a tubular shape for receiving said illuminators therein and being fittedly received in said respective mounting slot so as to securely mount said illuminating unit on said awning arm.

18. The outdoor umbrella, as recited in claim 17, further comprising an auxiliary electrical apparatus which comprises an electrical appliance mounted underneath said lower housing of said awning frame and a connecting wire electrically extended from said electrical appliance to said electric hub through said connecting arm.

19. The outdoor umbrella, as recited in claim 9, wherein each of said awning arms has a plurality of through holes spacedly provided thereon and said elongated element is mounted in said respective awning arm and head portions of said illuminators are arranged to protrude outside of said awning arms through said through slots.

20. The outdoor umbrella, as recited in claim 9, wherein said electric hub comprises a hub casing having a circular shaped received in said upper housing of said awning frame and at least a pair of electric wires protected by said hub casing for electrically connecting said first connectors.

21. The outdoor umbrella, as recited in claim 20, wherein said first connector comprises a tubular holder having a pair of engaging slots provided at a bottom surface of said tubular holder wherein ends of electric wires inside said electric hub are extended to said tubular holder through said engaging slots respectively, wherein said second connector comprises a connecting head having a rod-like shaped adapted to fittingly receive in said tubular holder of said first connector and a pair of parallel terminals outwardly protruded from said connecting head and electrically connected to said illuminators for fittingly inserting into said engaging slots respectively, so as to electrically connect said illuminating units to said electric hub.

22. The outdoor umbrella, as recited in claim 21, wherein each of said mounting slots has an arc-shaped cross section and opening downward and each of said elongated elements has a tubular shape for receiving said illuminators therein and being fittedly received in said respective mounting slot so as to securely mount said illuminating unit on said awning arm.

23. The outdoor umbrella, as recited in claim 21, wherein each of said awning arms has an elongated mounting slot having a U-shaped cross section formed thereon and said elongated element of said illuminating unit is fittedly received in said mounting slot so as to securely mount said illuminating unit on said awning arm.

24. The outdoor umbrella, as recited in claim 21, further comprising an auxiliary electrical apparatus which comprises an electrical appliance mounted underneath said lower housing of said awning frame and a connecting wire electrically extended from said electrical appliance to said electric hub through said connecting arm.

25. The outdoor umbrella, as recited in claim 20, wherein said electric cord is cut into predetermined sections wherein said first connector is provided at one end of said respective section of said electric cord and said second connector is provided at another end thereof, wherein said sections of said electric cord is detachably connected together by connecting said second connector with said first connector when assembling said outdoor umbrella.

26. The outdoor umbrella, as recited in claim 25, wherein each of said awning arms has an elongated mounting slot having a U-shaped cross section formed thereon and said elongated element of said illuminating unit is fittedly received in said mounting slot so as to securely mount said illuminating unit on said awning arm.

27. The outdoor umbrella, as recited in claim 25, each of said mounting slots has an arc-shaped cross section and opening downward and each of said elongated elements has a tubular shape for receiving said illuminators therein and being fittedly received in said respective mounting slot so as to securely mount said illuminating unit on said awning arm.

28. The outdoor umbrella, as recited in claim 25, further comprising an auxiliary electrical apparatus which comprises an electrical appliance mounted underneath said lower housing of said awning frame and a connecting wire electrically extended from said electrical appliance to said electric hub through said connecting arm.

29. The outdoor umbrella, as recited in claim 20, further comprising an auxiliary electrical apparatus which comprises an electrical appliance mounted underneath said lower housing of said awning frame and a connecting wire electrically extended from said electrical appliance to said electric hub through said connecting arm.

30. The outdoor umbrella, as recited in claim 1, wherein said electric hub comprises a hub casing having a circular shaped received in said upper housing of said awning frame and at least a pair of electric wires protected by said hub casing for electrically connecting said first connectors.

31. The outdoor umbrella, as recited in claim 9, further comprising an auxiliary electrical apparatus which comprises an electrical appliance mounted underneath said lower housing of said awning frame and a connecting wire electrically extended from said electrical appliance to said electric hub through said connecting arm.

32. The outdoor umbrella, as recited in claim 30, wherein said first connector comprises a tubular holder having a pair of engaging slots provided at a bottom surface of said tubular holder wherein ends of electric wires inside said electric hub are extended to said tubular holder through said engaging slots respectively, wherein said second connector comprises a connecting head having a rod-like shaped adapted to fittingly receive in said tubular holder of said first connector and a pair of parallel terminals outwardly protruded from said connecting head and electrically connected to said illuminators for fittingly inserting into said engaging slots respectively, so as to electrically connect said illuminating units to said electric hub.

33. The outdoor umbrella, as recited in claim 30, wherein said electric cord is cut into predetermined sections wherein said first connector is provided at one end of said respective section of said electric cord and said second connector is provided at another end thereof, wherein said sections of said electric cord is detachably connected together by connecting said second connector with said first connector when assembling said outdoor umbrella.

34. The outdoor umbrella, as recited in claim 1, wherein said electric hub comprises two C-shaped hub members, having a positive charge and a negative charge respectively, coaxially disposed in said upper housing of said awning frame wherein said first connectors are spacedly provided on said two hub members for electrically connecting said second connectors of said illuminating units respectively, wherein each of said second connectors has two connecting wires extended from said elongated element and arranged to mount on said two first connectors respectively, so as to electrically connect said illuminating units to said electric hub.

35. The outdoor umbrella, as recited in claim 34, wherein said electric cord is cut into predetermined sections wherein said first connector is provided at one end of said respective section of said electric cord and said second connector is provided at another end thereof, wherein said sections of said electric cord is detachably connected together by connecting said second connector with said first connector when assembling said outdoor umbrella.

36. The outdoor umbrella, as recited in claim 1, wherein said electric cord is cut into predetermined sections wherein said first connector is provided at one end of said respective section of said electric cord and said second connector is provided at another end thereof, wherein said sections of said electric cord is detachably connected together by connecting said second connector with said first connector when assembling said outdoor umbrella.

37. The outdoor umbrella, as recited in claim 1, further comprising an auxiliary electrical apparatus which comprises an electrical appliance mounted underneath said lower housing of said awning frame and a connecting wire electrically extended from said electrical appliance to said electric hub through said connecting arm.

38. An outdoor umbrella, comprising:

an awning;

a foldable awning frame which is constructed to support said awning thereon and comprises an upper housing, a lower housing, a plurality of awning arms radially extended from said upper housing in a pivotally movable manner, and at least a connecting arm pivotally connected one of said awning arms with said lower housing;

a supporting frame comprising a support stem and a supporting arm pivotally connecting said awning frame with said support stem; and a lighting arrangement, comprising:

an electric hub having an electric inlet disposed in said upper housing;

a control device which is provided along said supporting frame and comprises a power supply, an electric outlet detachably connecting to said electric inlet of said electric hub, and an electric cord electrically connecting said power supply with said electric outlet;

an electrical apparatus which comprises an electrical appliance mounted underneath said lower housing of said awning frame and a connecting wire electrically extended from said electrical appliance to said electric hub through said connecting arm;

a connecting device for electrically connecting said electrical apparatus with said electric hub, wherein said connecting device comprises a first connector provided on said electric hub and a second connector electrically connected to said electrical apparatus, wherein said electrical apparatus is capable of electrically connecting with said electric hub by connecting said second connector with said first connector.

39. The outdoor umbrella, as recited in claim 38, wherein said second connector is provided at an upper end of said connecting arm for detachably connected with said first connector, wherein said connecting device further comprises a third connector provided at a lower end of said connecting arm and electrically connected with said second connector and a fourth connector provided on said electrical apparatus for detachably connecting to said third connector.

40. The outdoor umbrella, as recited in claim 39, wherein said electric hub comprises two C-shaped hub members, having a positive charge and a negative charge respectively, coaxially disposed in said upper housing of said awning frame, wherein said second connector has two connecting wires extended from said electrical apparatus and arranged to mount on said two first connector respectively, so as to electrically connect said electrical apparatus to said electric hub.

41. The outdoor umbrella, as recited in claim 38, wherein said electric hub comprises a hub casing having a circular shaped received in said upper housing of said awning frame and at least a pair of electric wires protected by said hub casing for electrically connecting said first connector.

42. The outdoor umbrella, as recited in claim 41, wherein said first connector comprises a tubular holder having a pair of engaging slots provided at a bottom surface of said tubular holder wherein ends of electric wires inside said electric hub are extended to said tubular holder through said engaging slots respectively, wherein said second connector comprises a connecting head having a rod-like shaped adapted to fittingly receive in said tubular holder of said first connector and a pair of parallel terminals outwardly protruded from said connecting head and electrically connected to said electrical apparatus for fittingly inserting into said engaging slots respectively, so as to electrically connect said electrical apparatus to said electric hub.

43. The outdoor umbrella, as recited in claim 42, wherein said electrical apparatus is a lighting fixture.

44. The outdoor umbrella, as recited in claim 39, wherein said electric hub comprises a hub casing having a circular shaped received in said upper housing of said awning frame and at least a pair of electric wires protected by said hub casing for electrically connecting said first connector.

45. The outdoor umbrella, as recited in claim 38, wherein said electric hub comprises two C-shaped hub members, having a positive charge and a negative charge respectively, coaxially disposed in said upper housing of said awning frame, wherein said second connector has two connecting wires extended from said electrical apparatus and arranged to mount on said two first connector respectively, so as to electrically connect said electrical apparatus to said electric hub.

46. The outdoor umbrella, as recited in claim 45, wherein said first connector comprises a tubular holder having a pair of engaging slots provided at a bottom surface of said tubular holder wherein ends of electric wires inside said electric hub are extended to said tubular holder through said engaging slots respectively, wherein said second connector comprises a connecting head having a rod-like shaped adapted to fittingly receive in said tubular holder of said first connector and a pair of parallel terminals outwardly protruded from said connecting head and electrically connected to said electrical apparatus for fittingly inserting into said engaging slots respectively, so as to electrically connect said electrical apparatus to said electric hub.

47. The outdoor umbrella, as recited in claim 46, wherein said electrical apparatus is a lighting fixture.

48. The outdoor umbrella, as recited in claim 38, wherein said electrical apparatus is a lighting fixture.

* * * * *